United States Patent [19]

Gilbert

[11] 4,069,615

[45] Jan. 24, 1978

[54] SCREEN FOR DETERRING FLYING INSECTS

[76] Inventor: Donald E. Gilbert, Box 2188, Jonesboro, Ark. 72401

[21] Appl. No.: 743,957

[22] Filed: Nov. 22, 1976

[51] Int. Cl.[2] ..... E06B 9/52

[52] U.S. Cl. ..... 49/58; 43/107; 160/332; 98/36

[58] Field of Search ..... 43/107, 111; 49/58, 49/60; 160/332

[56] References Cited

U.S. PATENT DOCUMENTS 1,477,496 12/1923 Hutchison ..... 43/111

3,368,304 2/1968 Ball ..... 49/58

*Primary Examiner*—Louis G. Mancene
*Assistant Examiner*—Robert P. Swiatek
*Attorney, Agent, or Firm*—Robert Brown, Jr.

[57] ABSTRACT

A flying insect deterring screen composed of flexible tapes or strips suspended over an entry to a closed environment, wherein fluctuation throughout the length of the tapes is initiated by a prime mover acting at the points of suspension thereof. The prime mover initiates various types of fluctuating movement at the suspension points such as reciprocatory, oscillatory, circular and swirling motion, which motion is transmitted in waves to the lower end portions of the tapes.

5 Claims, 10 Drawing Figures

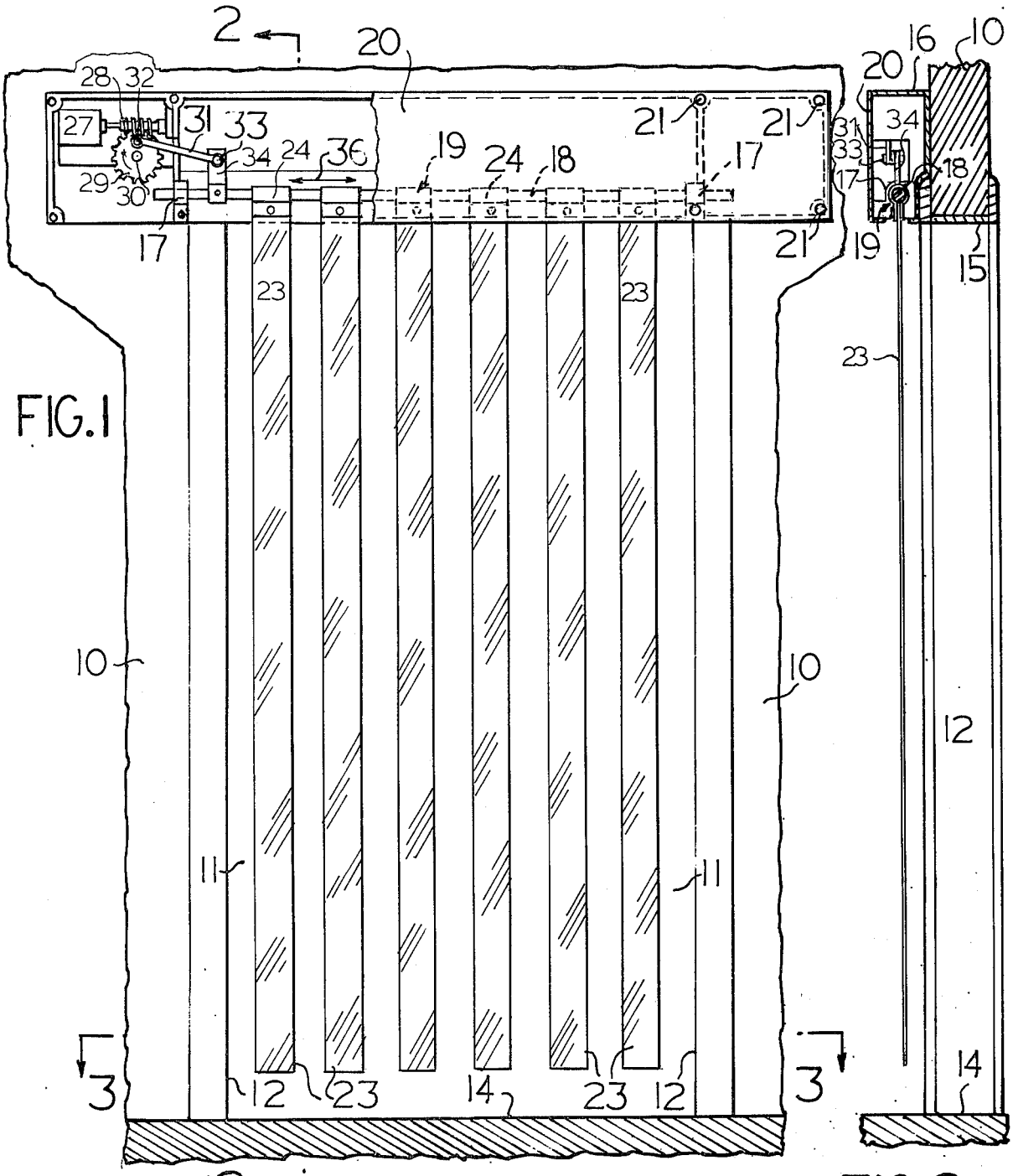
FIG. 1
FIG. 2
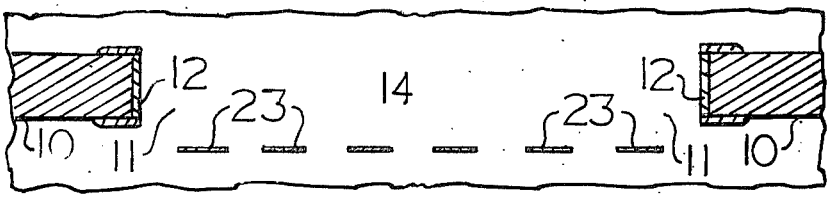
FIG. 3

FIG. 5
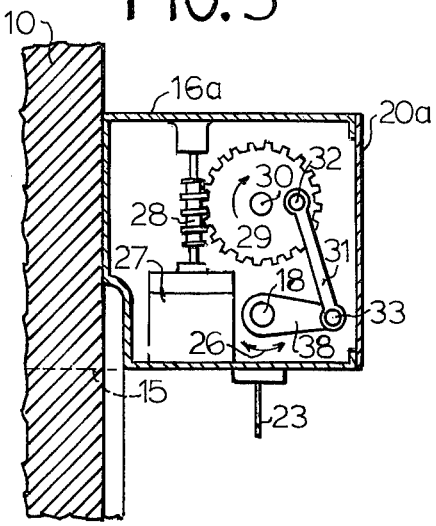
FIG. 4
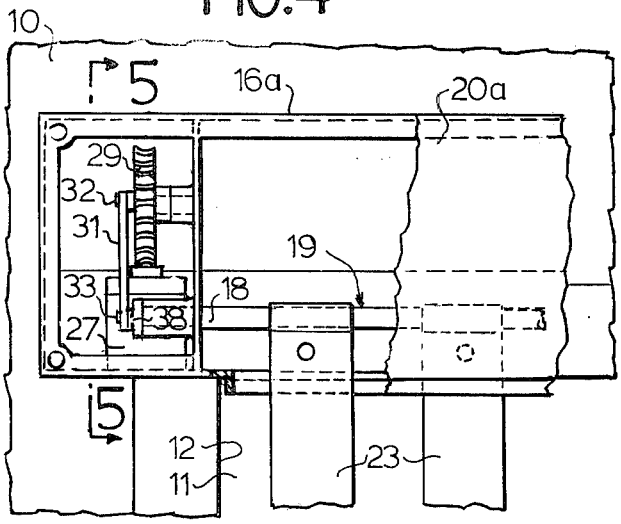
FIG. 7
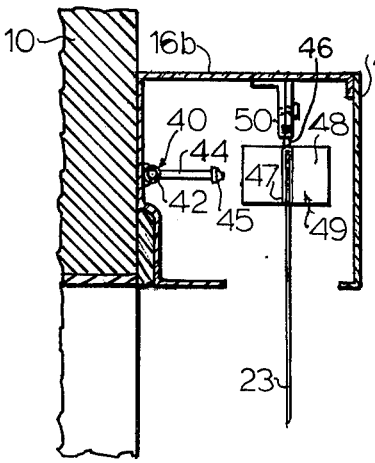
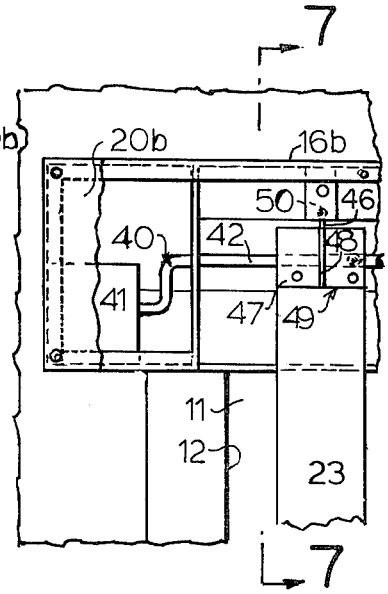
FIG. 6
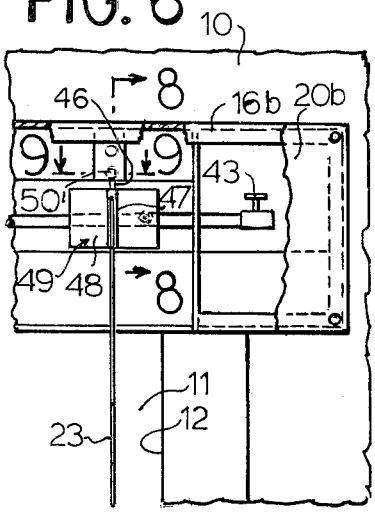
FIG. 8
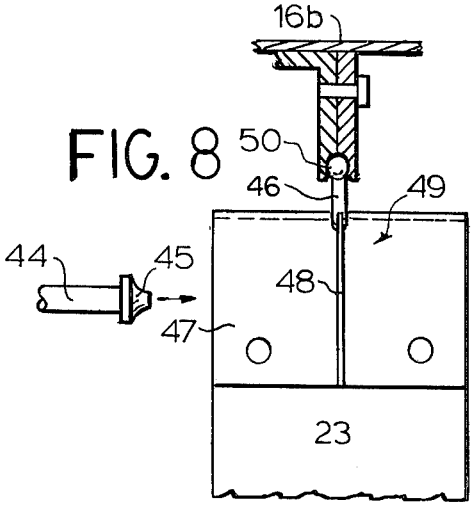
FIG. 9
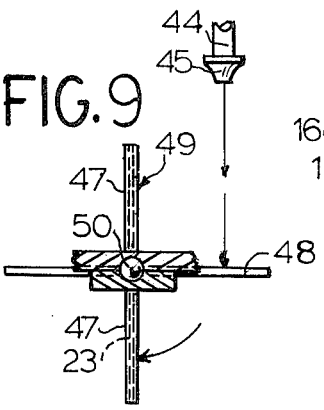
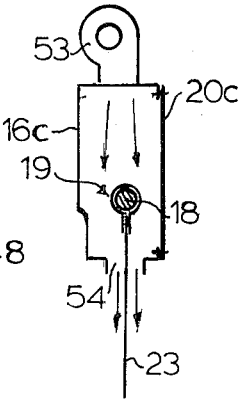
FIG. 10

SCREEN FOR DETERRING FLYING INSECTS

This invention relates to walk-through screens for openings of closed areas of buildings and the like, and more especially to screen assemblies composed of freely suspended strips or tapes suspended over an entrance, in combination with means for imparting fluctuation to the tapes to deter flying insects.

Heretofore, various types of devices of the class described have been provided which purport to scare the insects away from the doorways of buildings while permitting ventilation and ready access to and from the building. So far as applicant is aware, however, none of these prior art devices have met with appreciable market acceptance. For example, the British Pat. No. 882,638 of 1961 discloses a screen composed of tapes suspended over a doorway through which air currents flow horizontally to flucuate the tapes. Since each of the tapes acts as a pendulum, its amplitude of swing in response to the air current increases in direct proportion to the tape length. Hence, an air current having velocity necessary to produce the required fluctuation at the lower end portion of the suspended tape will produce inadequate fluctuation in the portion thereabove. Conversely, if the air velocity is adequate to produce the desired fluctuation in the portions near the points of suspension, the amplitude of swing and fluctuation at the lower portions of the tape will be excessive.

It is therefore an object of this invention to obviate the aforementioned drawbacks by providing a screen of suspended tapes, in combination with a prime mover acting at the points of suspension to initiate a flucuation which progressively travels downwardly in waves throughout the length of the tapes.

It is another object of invention to provide a screen assembly of the type described in the immediately preceding paragraph wherein the color of the tapes emits frequencies having wave lengths of the near ultraviolet range of 485 to 585 nanometers, thereby enhancing the visibility and insect deterring potential of the tapes while in motion.

Some of the objects of invention having been stated, other objects will appear as the description proceeds when taken in connection with the accompanying drawings, in which:

FIG. 1 is an elevational view of a doorway having suspended thereover one embodiment of my tape screen assembly;

FIG. 2 is a vertical sectional view taken along line 2—2 in FIG. 1;

FIG. 3 is a sectional plan view taken along line 3—3 in FIG. 1;

FIG. 4 is a fragmentary front elevation of a modified embodiment of the tape screen assembly shown in FIGS. 1-3;

FIG. 5 is a vertical sectional view taken along line 5—5 in FIG. 4;

FIG. 6 is a fragmentary elevation of another modified form of screen assembly;

FIG. 7 is a sectional detail view taken along line 7—7 in FIG. 6;

FIG. 8 is a sectional detail view taken along line 8—8 in FIG. 6;

FIG. 9 is a detail sectional plan view taken along 9—9 in FIG. 6, and

FIG. 10 is a diagrammatic cross-sectional view illustrating another embodiment of the invention.

Referring more particularly to the drawings, the numeral 10 denotes a building wall having a door opening 11 therein defined by vertical jambs 12, 12, floor 14, and head 15. Secured to one face of wall 10 and above the head 15 is a housing 16 having horizontally alined bearings 17, 17 mounted therein, which bearings slidably support a rod 18 of a screen assembly broadly designated by numeral 19. Housing 16 has a front access cover 20 removably mounted thereon by suitable means such as screws 21.

Assembly 19 also includes a plurality of tapes, strips or other elongated flexible members 23 which have the upper ends thereof fixedly secured around the rod 18 as at 24 and suspended over the door opening 11. Preferably, the members are made of plastic or similar materials in which an insect attracting fluorescent paint may be applied or impregnated. According to tests colors such as yellow or green which emit frequencies with wave lengths ranging from 485 to 585 nanometers are most effective. Although colors within the above near ultraviolet range serve as highly efficient insect attractants when used on stationary materials, they serve as equally efficient insect deterrants when incorporated in or painted on tapes to be fluctuated according to the present invention.

Fluctuation of tapes 23 of assembly 19 is initiated at the points of suspension 24 by imparting reciprocatory motion to the rod or shaft 18 (FIGS. 1-3), said fluctuation continuing downwardly in waves throughout the length of the tapes. The reciprocation is powered by a suitable prime mover such as motor 27 which drives the shaft through an intermediate leveraged connection composed of worm 28, worm gear 29, link 31 and arm 34 connected in the order named. Worm gear 29 is rotatably mounted as at 30 and has one of the link 31 eccentrically connected thereto as at 32, the opposite end of the link being scored as at 33 to arm 34 fixedly secured to rod 18. It will be observed that the radial portion of worm gear 29 disposed between points 30 and 32 is the mechanical equivalent of a lever or bellcrank for imparting the reciprocatory motion as the worm gear rotates, said motion being indicated by arrow 36.

FIGS. 4 and 5 illustrate a modified embodiment similar to FIGS. 1-3, but instead, effects tape fluctuation through oscillatory motion of shaft 18 as indicated by arrow 26. More particularly, the prime mover 27 is mounted in a housing **16*a*, 20*a* and drives the shaft 18 by means of an intermediate leveraged connection composed of worm 28, worm gear 29, link 31 and lever 38. Tapes 23 will be bodily oscillated since the points of suspension thereof are disposed eccentrically on the periphery of shaft 18**.

FIGS. 6-9 shown another embodiment of the invention in which a pneumatic prime mover assembly 40 is mounted in a housing **16*b*, 20*b*, which assembly initiates swirling fluctuation by rotating each tape 23** at its point of suspension to torsionally flex and transmit the initial fluctuation progressively downwardly in waves.

Assembly 40 consists of: a miniature air compressor 41; an air distribution line 42 extending horizontally from the compressor; an air regulator valve 43 at the end of the line; branch lines 44 extending transversely from and at spaced points along the distribution line corresponding to the suspension points of the tapes 23; and a nozzle 45 on the end of each branch line. The prime mover assembly 40 directs a jet of air from each of the nozzles 45 to impart rotary motion to vertically disposed shaft 46 through an intermediate leveraged connection composed of blades or levers 47 and 48 extending radially from the shaft. The members 46, 47 and 48 are arranged in the form of a paddle wheel assembly 49 which is suspended from the upper portion of housing 16*b* by means of a ball and socket connection 50, a tape 23 being suspended from each wheel. Thus, a jet of air from nozzle 45 will rotate wheel 49 and the attached tape 23 about connection 50 to initiate torsional stress and fluctuating movement travelling downwardly in waves to the lower end of the tape.

The embodiment shown in FIG. 10 embodies essentially the same principle of operation as in the previously described embodiments, but with another type of pneumatic prime mover, consisting of a fan or blower 53 communicating with the interior of a housing 16*c*, 20*c*, said housing having an elongated horizontal orifice or nozzle 54 in its bottom wall. The tape assembly 19 is suspended within the housing at a location adjacently above the nozzle 54 so as to permit the upper portions of tapes 23 to hang freely through the nozzle. The blower 53 directs a blast of air into housing 16*c*, 20*c* and downwardly through nozzle 54 on opposite sides of the tapes. As the converged current of air passes through the nozzle, tape fluctuation will be initiated which continues downwardly in waves to the ends of the tapes.

I claim:

1. A screen assembly for deterring entry of flying insects into a closed environment, comprising a plurality of flexible tapes, means for suspending said tapes over the entry of said environment, a prime mover, and means including a shaft responsive to the operation of said prime mover and acting at said point of suspension for initiating fluctuation of said tapes, said last-named means including a leveraged connection between said shaft and said prime mover for imparting rotary movement from the latter to the former.

2. A screen assembly for deterring entry of flying insects into a closed environment, comprising a plurality of flexible tapes, means for suspending said tapes over the entry of said environment, a prime mover, and means including a shaft responsive to the operation of said prime mover and acting at said point of suspension for initiating fluctuation of said tapes, said last-named means including a leveraged connection between said shaft and said prime mover for imparting reciprocatory movement longitudinally of said shaft.

3. A screen assembly for deterring entry of flying insects into a closed environment, comprising a plurality of flexible tapes, means for suspending said tapes over the entry of said environment, a prime mover, and means including a shaft responsive to the operation of said prime mover and acting at said point of suspension for initiating fluctuation of said tapes, said last-named means including a leveraged connection between said shaft and said prime mover for imparting oscillatory movement to the shaft about its longitudinal axis.

4. A screen assembly for deterring entry of flying insects into a closed environment, comprising a prime mover including a housing having a slotted nozzle in its lower wall, and a blower for supplying air into said housing; a plurality of flexible tapes; and means for freely suspending said tapes centrally through said slotted nozzle and over the entry of said environment to thereby cause the air in said housing to flow downwardly through said nozzle on opposite sides of the tapes.

5. The assembly defined in claim 1 wherein the color of said tapes emits frequencies having wave lengths predominantly ranging from 485 to 585 nanometers.

* * * * *